US009103159B2

(12) United States Patent
Kim

(10) Patent No.: US 9,103,159 B2
(45) Date of Patent: Aug. 11, 2015

(54) APPARATUS FOR AN AUTOMATIC DOOR WITH AN AIRTIGHT FRAME

(76) Inventor: Soon Seok Kim, Gyeonggi-do (KR)

( * ) Notice: Subject to any disclaimer, the term of this patent is extended or adjusted under 35 U.S.C. 154(b) by 0 days.

(21) Appl. No.: 14/232,288

(22) PCT Filed: Mar. 20, 2012

(86) PCT No.: PCT/KR2012/001983

§ 371 (c)(1),
(2), (4) Date: Jan. 13, 2014

(87) PCT Pub. No.: WO2013/015507

PCT Pub. Date: Jan. 31, 2013

(65) Prior Publication Data

US 2014/0137476 A1 May 22, 2014

(30) Foreign Application Priority Data

Jul. 25, 2011 (KR) ..... 10-2011-0073411

(51) Int. Cl.

| | |
|---|---|
| ***E06B 3/46*** | (2006.01) |
| ***E06B 7/18*** | (2006.01) |
| ***E06B 7/232*** | (2006.01) |
| *E06B 3/58* | (2006.01) |
| *E06B 7/23* | (2006.01) |

(52) U.S. Cl.

CPC ..... *E06B 3/4609* (2013.01); *E06B 7/18* (2013.01); *E06B 7/231* (2013.01); *E06B 7/232* (2013.01); *E05Y 2201/614* (2013.01); *E06B 3/5821* (2013.01); *E06B 7/2309* (2013.01)

(58) Field of Classification Search

CPC ..... E06B 7/18; E06B 7/212; E06B 7/232; E06B 7/2309; E06B 3/4609; E06B 3/5821; E05Y 2201/614

USPC ..... 49/409, 410, 411, 467, 469, 470, 504, 49/501, 404; 52/207

See application file for complete search history.

(56) References Cited

U.S. PATENT DOCUMENTS 3,442,051 A * 5/1969 Johnson et al. ..... 49/414
3,859,754 A * 1/1975 Budich et al. ..... 49/425

(Continued)

FOREIGN PATENT DOCUMENTS

JP 06-058062 3/1994
JP 1994040264 5/1994

(Continued)

*Primary Examiner* — Katherine Mitchell
*Assistant Examiner* — Marcus Menezes
(74) *Attorney, Agent, or Firm* — Mark M. Friedman

(57) ABSTRACT

There is provided an apparatus for an automatic/semiautomatic door, and more particularly, to an apparatus for an automatic/semiautomatic door to prevent the door from leaving its track during an opening/closing process and to maintain airtightness between the inside and the outside when closed. In the apparatus for the automatic/semiautomatic door, airtight frames are separably assembled at the top, bottom and both sides of the automatic/semiautomatic door and wherein an airtight structure is buried in a floor surface coming in contact with the bottom of an opening/closing door of the automatic/semiautomatic door, so that the airtight frame is air-tightly and slidably inserted into the airtight structure. Therefore, any gap between the inside and outside is blocked to improve airtightness by preventing drafts, noise, etc. and the opening/closing door is prevented from shaking or leaving its track.

6 Claims, 13 Drawing Sheets

(56) References Cited

U.S. PATENT DOCUMENTS

| | | | | |
|---|---|---|---|---|
| 6,243,999 | B1 * | 6/2001 | Silverman | 52/204.51 |
| 6,416,144 | B1 * | 7/2002 | Houston et al. | 312/209 |
| 7,555,871 | B1 * | 7/2009 | Neal | 52/204.51 |
| 8,683,747 | B2 * | 4/2014 | Kim | 49/471 |
| 2002/0157317 | A1 * | 10/2002 | Valencia et al. | 49/360 |
| 2008/0092452 | A1 * | 4/2008 | Chubb et al. | 49/458 |
| 2011/0126471 | A1 * | 6/2011 | Hans | 49/409 |
| 2011/0304252 | A1 * | 12/2011 | Stubblefield | 312/405 |

FOREIGN PATENT DOCUMENTS

| | | |
|---|---|---|
| JP | 2000-045654 | 2/2000 |
| JP | 2003-048243 | 2/2003 |
| WO | WO 2010101351 A2 * | 9/2010 |

* cited by examiner

APPARATUS FOR AN AUTOMATIC DOOR WITH AN AIRTIGHT FRAME

TECHNICAL FIELD

The present invention relates to an apparatus for an automatic/semiautomatic door, and more particularly, to an apparatus for an automatic/semiautomatic door to prevent the door from leaving its track during an opening/closing process and to maintain airtightness between the inside and the outside when closed.

BACKGROUND ART

Usually an automatic/semiautomatic door (hereinafter, referred to as 'automatic door') is a convenient apparatus providing people with the convenience of automatically opening/closing when the people enter/exit. This automatic door uses a variety of driving means, such as hydraulic means, electrically driven means, pneumatic means, etc.

The opening/closing driving apparatus of an automatic door comprises: a sensor to sense an entering/exiting person; a controller to control whether or not to drive a motor by a signal of the sensor; and a decelerator to decelerate, at a deceleration position, the speed of the door which laterally slides to the open/closed position by the driving of the motor.

Generally, an automatic door comprises a fixed door to be fixedly installed within a door frame, and an opening/closing door to laterally slide to the fixed door and to an open/closed position. The top of the opening/closing door is connected to the driving means (hydraulic means, electrically driven means, pneumatic means, etc.) of the opening/closing driving apparatus so that sliding power is transferred.

More specifically, the top of the opening/closing door is connected to the driving means of the opening/closing driving apparatus. It is hung like a hanger. The bottom of the opening/closing door is provided with a roller(s) to roll along a bottom rail(s).

Accordingly, the opening/closing door laterally slides to the open/closed position by the operation of the opening/closing driving means. Simultaneously, the roller(s) installed at the bottom of the opening/closing door rolls along the rail(s), to open/close the automatic door.

However, a conventional automatic door has the following drawbacks:

Since any airtightness maintaining structure is not provided in the conventional automatic door, a draft or rainwater easily comes in through a gap between the fixed door and the opening/closing door of the automatic door and a gap between the opening/closing door and the rail(s), so that airtightness or drainage considerably drop.

Especially, drafts and extraneous noise easily come into through the gap between the top of the opening/closing door and the door frame of the automatic door and the gap between the bottom of the opening/closing door and the rail(s). Furthermore, when the automatic door is installed to directly contact with the outside (like the automatic door of a store, etc.), since no drainage structure from the inside towards the outside exists, rainwater, etc. coming in the inside cannot be immediately removed.

Moreover, although the top of the opening/closing door installed in the conventional automatic door is hung by being connected to the opening/closing driving apparatus, since the bottom thereof is a free end to simply move along the rail(s), it is easily shaken by the wind or it easily leaves by a certain impact against the door.

DISCLOSURE

Technical Problem

Therefore, it is an object of the present invention to solve the above problems of the conventional automatic door and to provide an apparatus for an automatic/semiautomatic door (hereinafter, referred to as the automatic door), wherein airtight frames are separably assembled at the top, bottom and both sides of the automatic door and wherein an airtight structure is buried in a floor surface coming in contact with the bottom of an opening/closing door of the automatic door, so that the airtight frame is air-tightly and slidably inserted into the airtight structure. Therefore, any gap between the inside and outside is blocked to improve airtightness by preventing drafts, noise, etc. Further, the opening/closing door is prevented from shaking or leaving its track.

Technical Solutions

In accordance with an aspect of the present invention, there is provided an apparatus for an automatic/semiautomatic door (hereinafter, referred to as the automatic door) comprising: a first airtight frame to be assembled with a top of a fixed door of the automatic door and one side of the fixed door coming in contact with a left-side door frame; a second airtight frame to be assembled with a bottom and the other side of the fixed door and a top, bottom and both sides of an opening/closing door of the automatic door to be connected to opening/closing driving means; a first airtight maintaining structure to be buried in a floor surface facing a bottom of the second frame so that the bottom of the second airtight frame installed at the bottom of the opening/closing door is inserted to slide along opening/closing directions; a second airtight maintaining structure to be installed at a right-side door frame facing the other side of the opening/closing door so that the other side being a closed side of the opening/closing door is inserted; and a third airtight maintaining structure to be finally assembled with the second airtight frame assembled with the other side of the fixed door and the second airtight frame assembled with the one side of the opening/closing door.

The first airtight frame comprises: an outer plate including a flange and a groove, wherein the flange downwardly extends from one side of the outer plate in a single unit, to be inserted into a molding material at one side of the fixed door, and the groove is formed inside the other side of the outer plate; and a coupling clip including coupling legs and a coupling protrusion, wherein the coupling legs are formed at one side of the coupling clip, to be fitted into the groove of the outer plate and the coupling protrusion is formed at another side of the coupling clip, to be inserted into the molding material at the other side of the fixing door.

The second airtight frame comprises: a hollow frame in a hollow rectangular sectional structure including a groove, protruding ends with coupling grooves, and a flange, wherein the groove is formed at one position on one side of the hollow frame, the protruding ends with the coupling grooves are formed at the other side of the hollow frame in a single unit, and the flange extends from the other position of the one side of the hollow frame in a single unit, to be inserted into the molding material at the fixed door or the opening/closing door; and a coupling clip including coupling legs and a coupling protrusion, wherein the coupling legs are formed at one side of the coupling clip, to be fitted into the groove, and the coupling protrusion is formed at another side thereof, to be inserted into the molding material at the other side of the fixed door.

The first airtight maintaining structure comprises: a connection frame to be inserted into protruding ends of the second airtight frame installed at the bottom of the opening/closing door; a floor buried structure including first connection grooves and first connection protrusions, wherein the first connection grooves are formed at both inner sides of the floor buried structure and the first connection protrusions upwardly protrude from the center of the bottom of the floor buried structure in a single unit, so that the floor buried structure is buried in the floor surface facing the bottom of the second airtight frame; a first cover structure including second connection protrusions and second connection grooves, wherein the second connection protrusions downwardly protrude from the bottom of the first cover structure in a single unit, to be connected by being inserted into the first connection protrusions of the floor buried structure, and the second connection grooves are formed at its both outer sides; and first and second airtight sealing to be inserted into the first connection grooves of the floor buried structure and the second connection grooves of the first cover structure, respectively, so as to be secured to both sides of the connection frame.

The second airtight maintaining structure comprises: a wall buried structure including third connection grooves and third connection protrusions, wherein the third connection grooves are formed at its both wall sides, the third connection protrusions are protrude extending from the wall buried structure and the wall buried structure is formed at an inner wall side of the right-side door frame in a single unit; a second cover structure including fourth connection protrusions and fourth grooves, wherein the fourth connection protrusions protrude from the second cover structure in a single unit, to be inserted into the third connection protrusions of the floor buried structure, and the fourth connection grooves are formed at both outer sides the second cover structure; and third and fourth airtight sealing to be inserted into the third connection grooves of the floor buried structure and the fourth connection grooves of the second cover structure, respectively, so as to be secured to both sides of the protruding ends of the second airtight frame installed at the other side which is a closed side of the opening/closing door.

Third airtight maintaining structure comprises: a first cover-type structure in a cover-type structure, including first locking ends and fifth airtight sealing, wherein the first locking ends are formed at an inner side of the first cover-type structure in a single unit, to be insertedly locked in the coupling grooves of the protruding ends of the second airtight frame installed at the one side of the opening/closing door and the fifth airtight sealing is mounted at the side towards the fixed door, to be secured to the second airtight frame installed at the fixed door; and a second cover-type structure including second locking ends and sixth airtight sealing, wherein the second locking ends are formed in a single unit, to be locked in the coupling grooves of the protruding ends of the second airtight frame installed at the other side of the fixed door, and the sixth airtight sealing is mounted at the side towards the opening/closing door, to be secured to the second airtight frame installed at the opening/closing door.

Preferably, the apparatus may further comprise: when the floor buried structure is not completely buried in the floor surface, an inclination plate in a hollow type tilting from the inside towards the outside to be assembled at the outer wall surface of the floor buried structure in a single unit; and drainage holes formed on the first connection protrusions and the outer wall surface of the floor buried structure and the inclination plate.

Preferably, the apparatus may further comprise: when the opening/closed door is in a bi-parting door structure, seventh airtight sealing to be installed at the side of the first opening/closing door coming in contact with the second opening/closing door; and eighth airtight sealing to be installed at the side of the second opening/closing door coming in contact with the first opening/closing door, wherein each of the seventh airtight sealing and each of the eighth airtight sealing are arranged to alternate each other.

Advantageous Effects

The present invention through the technical solution described above provides the following effects:

In accordance with the present invention, the airtight frames are separably assembled at the top, bottom and both side of the opening/closing door as well as the fixed door of the automatic door. The airtight structure is installed to be buried in the floor surface coming in contact with the bottom of the opening/closing door of the automatic door so that the airtight frame is air tightly and slidably inserted.

1) Accordingly, the present invention prevents drafts and extraneous noise from easily coming in through the gap between the top of the opening/closing door and the door frame of the automatic door and the gap between the bottom of the opening/closing door and the rail(s).

2) When the automatic door is installed directly in contact with the outside, the drainage structure from the inside towards the outside is applied, so that rainwater coming into the airtight frames and the inside is immediately taken away to the outside.

3) Although the top of the opening/closing door of the automatic door is hung by being connected to the opening/closing driving apparatus, since the airtight frame installed at the bottom of the opening/closing door is inserted into a floor buried structure buried in the floor surface and it moves to the open/closed position, the opening/closing door is prevented from being easily shaken or leaving its track by drafts.

DESCRIPTION OF DRAWINGS

These and other aspects and advantages of the present invention will become apparent and more readily appreciated from the following description of the embodiment(s), taken in conjunction with the accompanying drawings, in which.

BEST MODE

Figure 1:
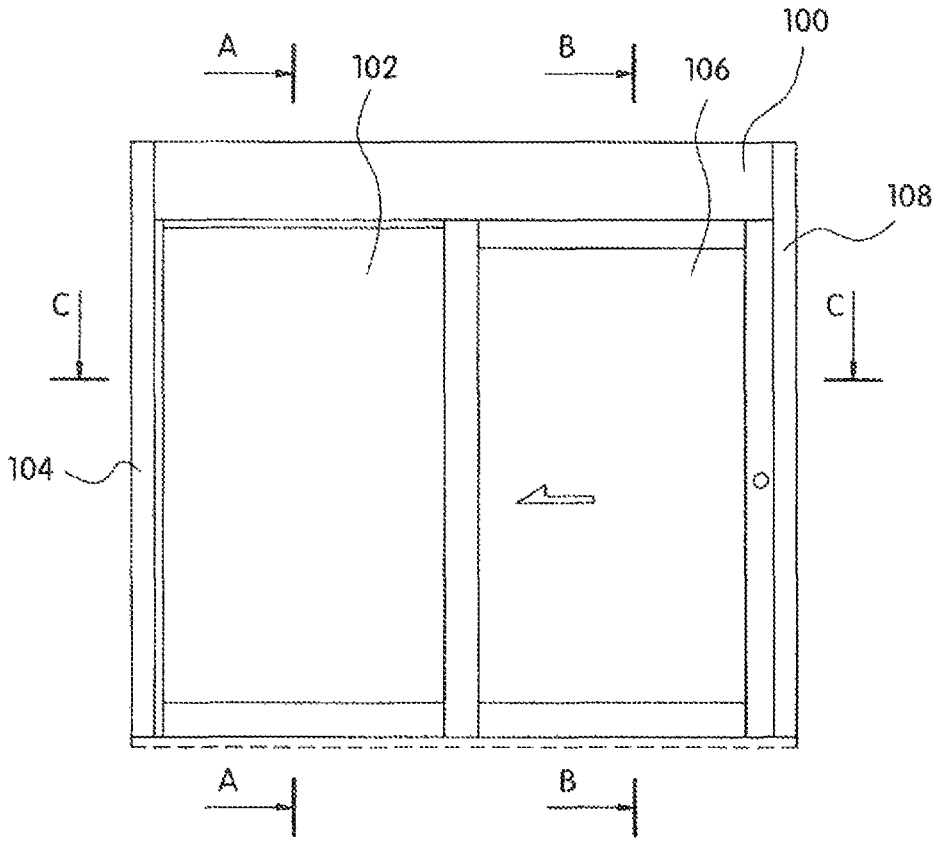
FIG. 1 is a schematic view of an automatic single door to which an apparatus for an automatic/semiautomatic door according to the present invention is applied.
Figure 2:
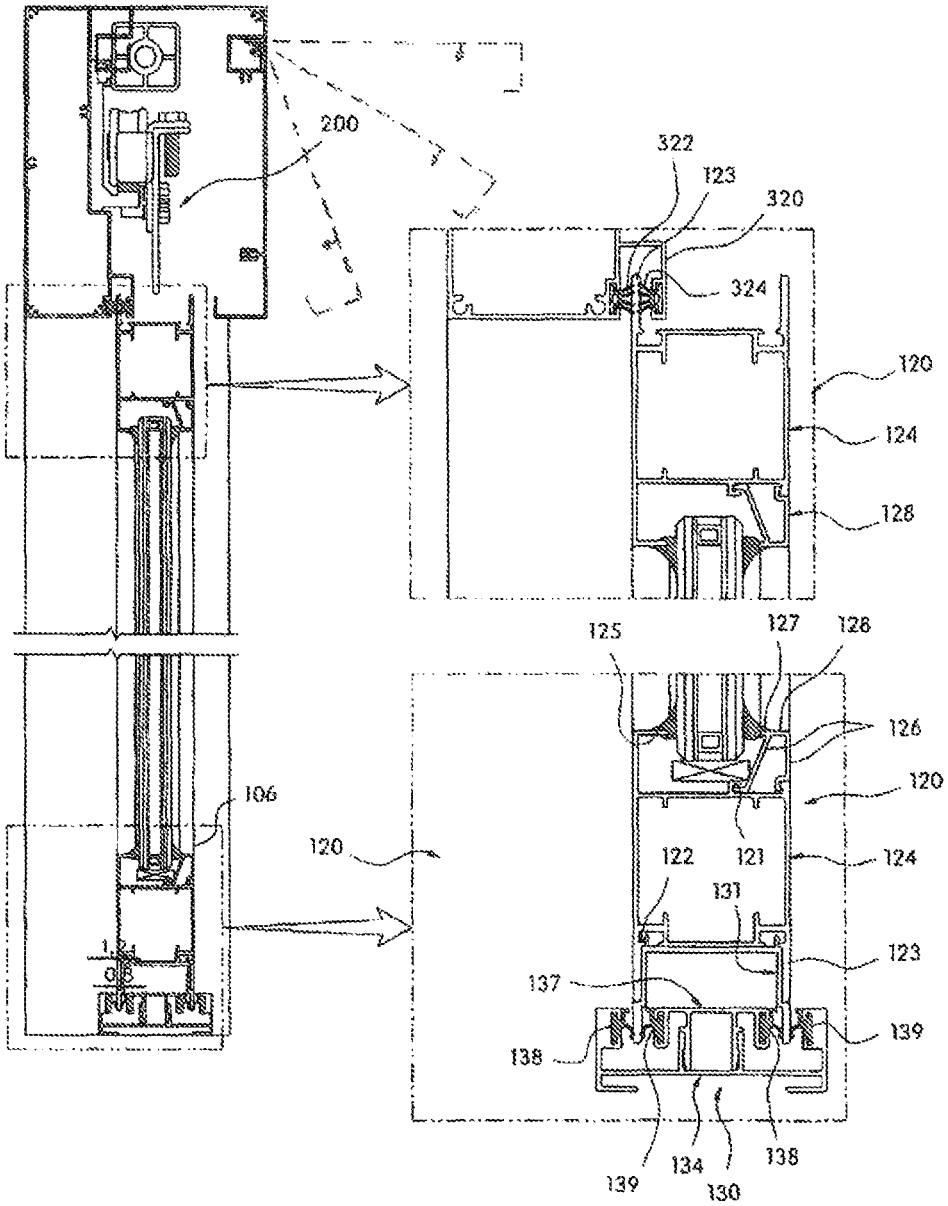
FIG. 2 is a cross-sectional view taken along a Line A-A in FIG. 1.
Figure 3:
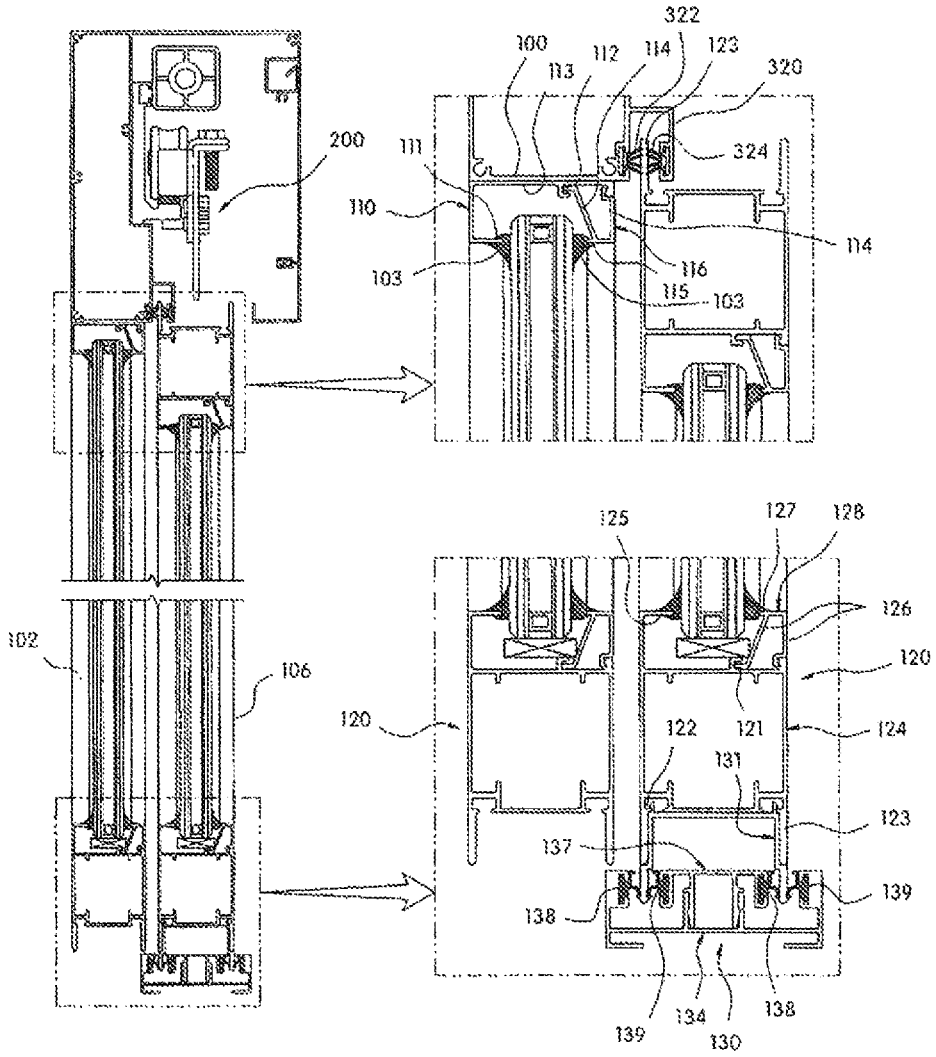
FIG. 3 is a cross-sectional view taken along a Line B-B in FIG. 1.
Figure 4:
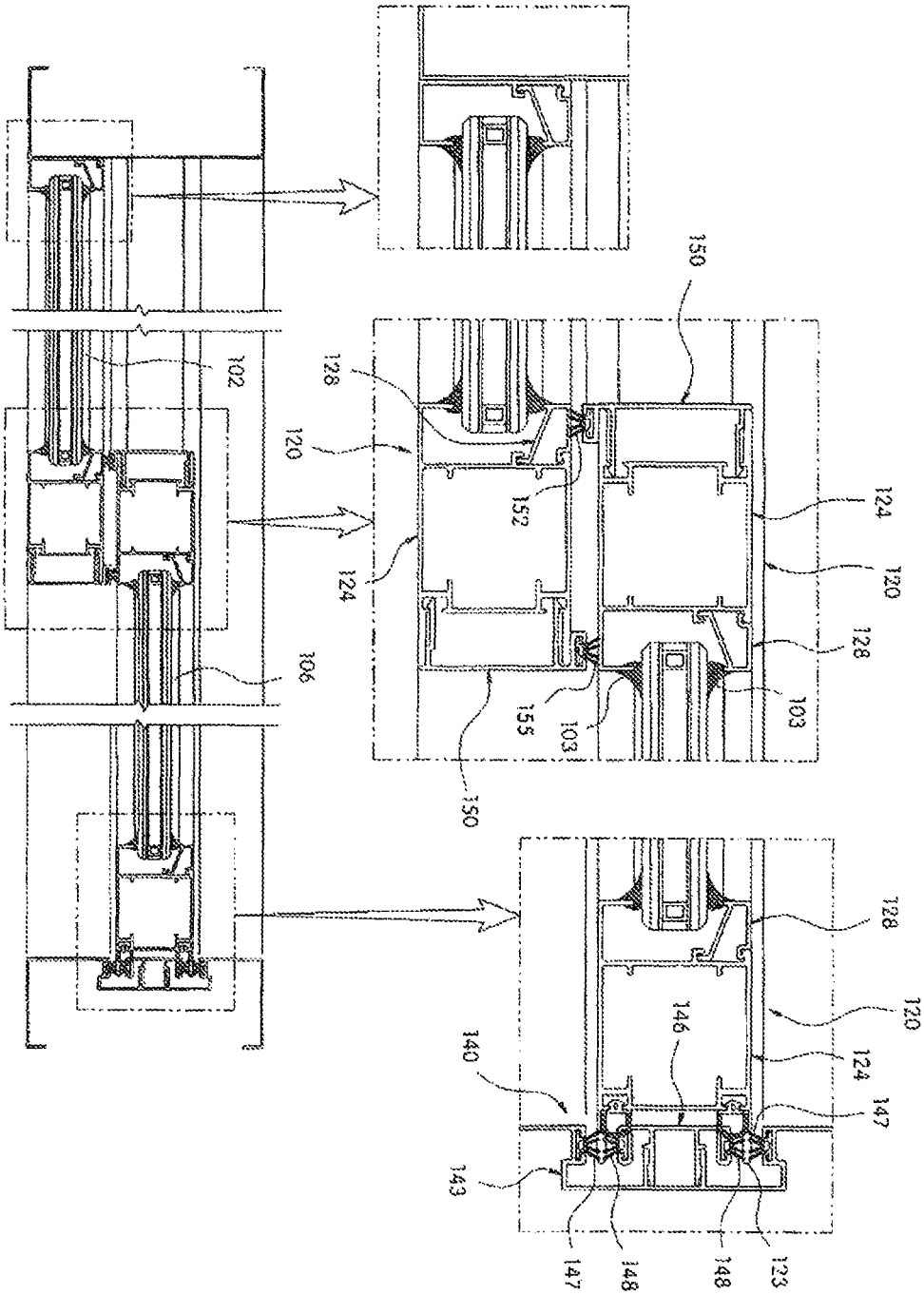
FIG. 4 is a cross-sectional view taken along a Line C-C in FIG. 1.
Figure 5:
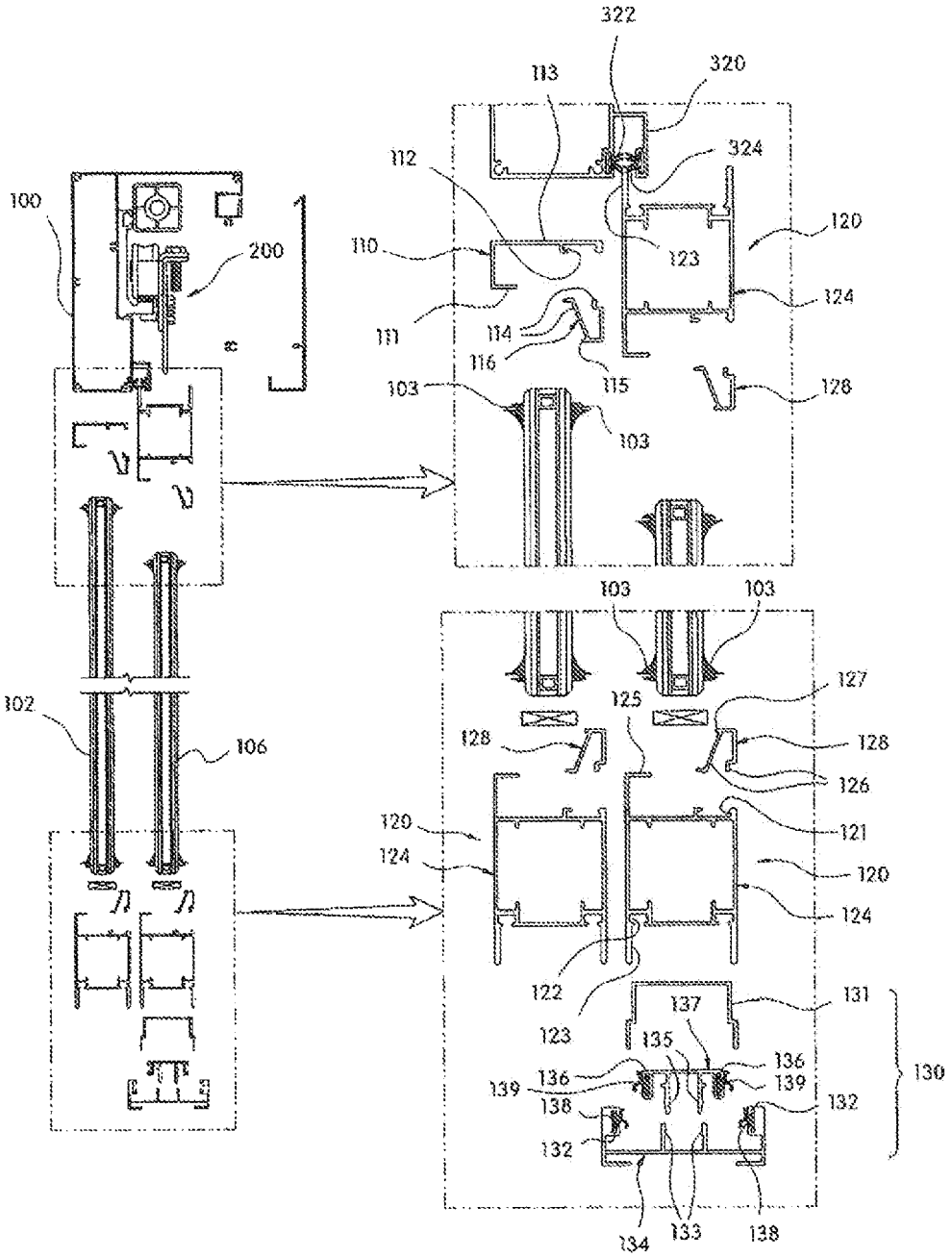
FIG. 5 is a longitudinal sectional view of the separated apparatus according to the present invention.
Figure 6:
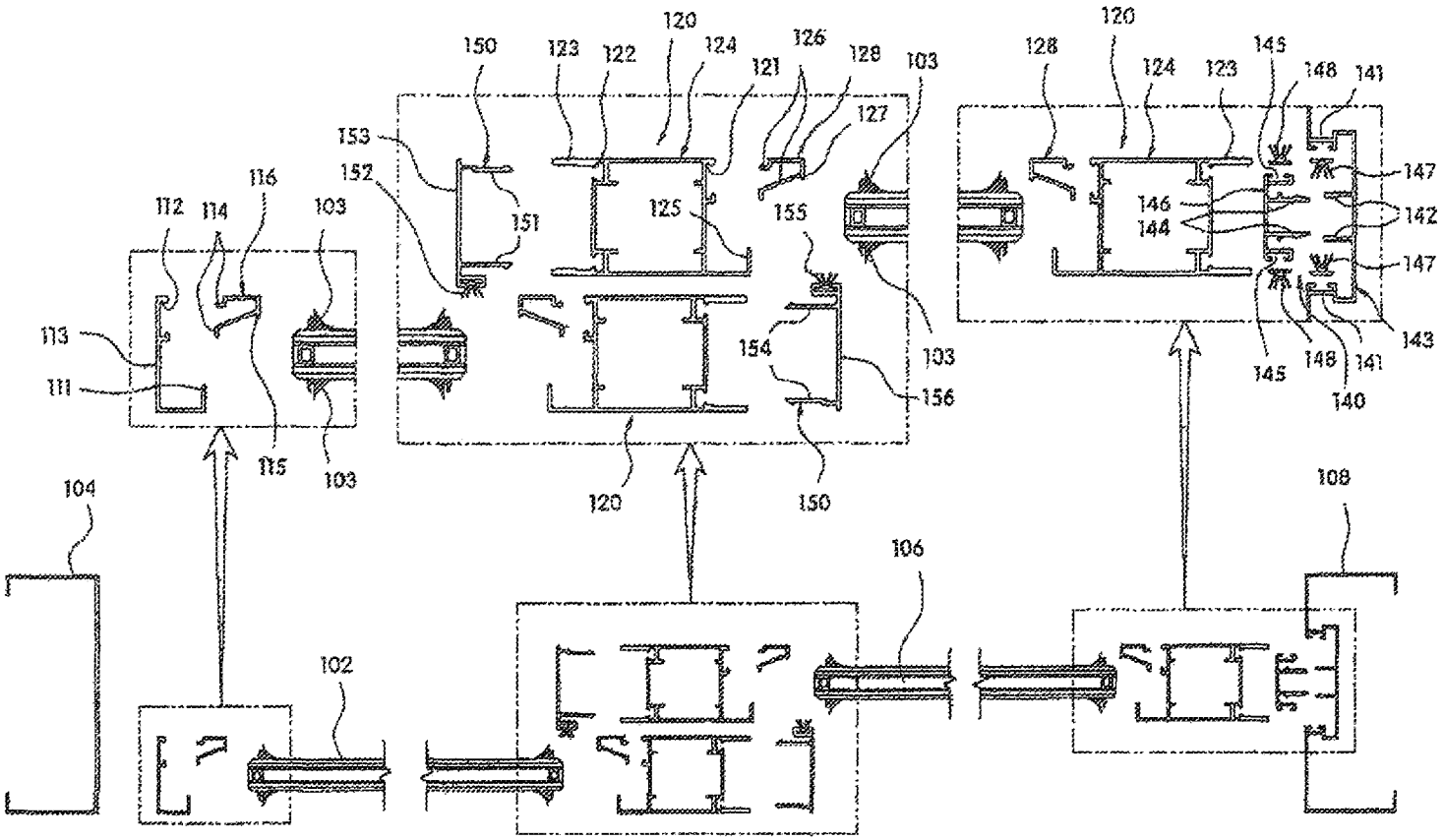
FIG. 6 is a transverse sectional view of the separated apparatus according to the present invention.

The technical characteristics of the present invention will be specifically described with reference to the accompanying drawings.

FIGS. 1 through 6 show an apparatus of an automatic/semiautomatic door (hereinafter, referred to as the 'automatic door') according to an embodiment of the present invention, which is applied to an automatic single door.

The apparatus according to the present invention puts emphasis on the point that an airtight structure is added to all edges of the automatic door and a door frame, to easily prevent drafts, noise, etc., from passing beyond the door.

To this end, at a top of a fixed door 102 coming in contact with a top-side door frame 100 and one side of the fixed door coming in contact with a left-side door frame 104, a first airtight frame 110 manufactured in the same structure is separably assembled.

The first airtight frame 110 is mounted to the top of the fixed door 102 to be secured to the top-side door frame 10 and it is mounted to the one side of the fixed door 102 to be secured to the left-side door frame 104.

In more detail, the first airtight frame 110 includes an outer plate 113 and a coupling clip 116. The outer plate 113 includes a flange 111 and a groove 112. The flange 111 is formed by extending from the outer plate 113 in a single unit, to be inserted into a molding material 103 at one side of the fixed door 102. The groove 112 is formed inside the outer plate 113. The coupling clip 116 includes coupling legs 114 and a coupling protrusion 115. The coupling legs 114 are formed at one side of the coupling clip 116, to be fitted into the groove 112 of the outer plate 113. The coupling protrusion 115 is formed at another side of the coupling clip 116, to be inserted into another molding material 103 at the other side of the fixed door 102.

Then, the external surface of the outer plate 113 of the first airtight frame 110 is secured to the top-side door frame 100 or the left-side door frame 104 and the flange 111 of the outer plate 113 is inserted into the molding material 103 at the one side of the fixed door 102 so that the outer plate 113 is fixed. Further, the coupling protrusion 115 of the coupling clip 116 is inserted into the molding material 103 at the other side of the fixed door 102 and simultaneously the coupling legs 114 of the coupling clip 116 are fitted into the groove 112 of the outer plate 113, thereby completing the assembly of the first airtight frame 110 with the outer plate 113 and the coupling clip 116 to the fixed door 102.

A second airtight frame 120 manufactured in the same structure is separably assembled at the bottom and the other side of the fixed door 102 and the top, bottom and both sides of an opening/closing door 106 of the automatic door, which is connected to opening/closing driving means 200.

The second airtight frame 120 has a hollow rectangular sectional structure. The second airtight frame 120 includes a hollow frame 124 and a coupling clip 128. The hollow frame 124 further includes a groove 121, coupling grooves 122, protruding ends 123 and a flange 125. The groove 121 is formed at one position of one side of the hollow frame 124. The flange 125 to be inserted into the molding material 103 at one side of the fixed door 102 or the opening/closing door 106 protrudes from the other position of the one side of the hollow frame 124 in a single unit. The protruding ends 123 including the coupling grooves 122 are formed at the other side of the hollow frame 124 in a single unit. The coupling clip 128 includes coupling legs 126 and a coupling protrusion 127. The coupling legs 126 are formed at one side of the coupling clip 128 to be fitted into the groove 121 of the hollow frame 124. The coupling protrusion 127 is formed at another side of the coupling clip 128 to be inserted into the molding material 103 at the other side of the fixed door 102.

The flange 125 of the second airtight frame 120 is inserted into the molding material 103 at the one side of the fixed door 102 or the opening/closing door 106, the coupling legs 126 of the coupling clip 128 are fitted into the groove 121 of the hollow frame 124 and simultaneously the coupling protrusion 127 is inserted into the molding material 103 at the other side of the fixed door 102 or the opening/closing door 106, thereby completing the assembly of the second airtight frame 120 with the hollow frame 124 and the coupling clip 128 to the fixed door 102 or the opening/closing door 106.

The top-side door frame 100 forms a notch 320 in a single unit. The notch 320 is vertically cut to receive the protruding end 123 of the second airtight frame 120 installed at the top of the opening/closing door 106. Ninth airtight sealing 322 and tenth airtight sealing 324 are installed in an inner wall of the top-side door frame 100 and an inner side of the notch 320, respectively.

When the opening/closing door 106 slides to an open/closed position, the protruding end 123 of the second airtight frame 120 is inserted between the ninth airtight sealing 322 and the tenth airtight sealing 324 respectively installed in the inner wall of the top-side door frame 100 and the inner side of the notch 320, to prevent drift and noise penetration.

In accordance with the present invention, the first and second airtight frames 110, 120 assembled to the fixed door 102 and opening/closing door 106 function to prevent drift and noise penetration, together with first, second and third airtight maintaining structures 130, 140, 150.

The first airtight maintaining structure 130 is buried in or installed on, by a non-buried manner, a floor surface facing the bottom of the second airtight frame 120 installed at the bottom of the opening/closing door 106, to receive the bottom of the second airtight frame 120 so as to slide along the opening/closing directions.

The first airtight maintaining structure 130 comprises a connection frame 131, a floor buried structure 134, a first cover structure 137 and first and second airtight sealing 138, 139. The connection frame 131 is inserted between the protruding ends 123 of the second airtight frame 120 installed at the bottom of the opening/closing door 106. The floor buried structure 134 includes first connection grooves 132 and first connection protrusions 133. The first connection grooves 132 are formed at both inner sides of the floor buried structure 134. The first connection protrusions 133 upwardly protrude from the center of the bottom of the floor buried structure 134 in a single unit. The floor buried structure 134 is buried in the floor surface facing the bottom of the second airtight frame 120 or it is fixedly installed on the floor surface. The first cover structure 137 includes second connection protrusions 135 and second connection grooves 136. The second connection protrusions 135 downwardly protrude from the bottom of the first cover structure 137 in a single unit, to be fitted into and connected to the first connection protrusions 133 of the floor buried structure 134. The second connection grooves 136 are formed at both outer sides of the first cover structure 137. Specifically, the first airtight sealing 138 is inserted into the first connection grooves 132 of the floor buried structure 134 and the second airtight sealing 139 is inserted into the second connection grooves 136 of the first cover structure 137, to be secured to both inside and outside of the connection frame 131.

The connection frame 131 fitted into the protruding ends 123 of the second airtight frame 120 installed at the bottom of the opening/closing door 106 is inserted into the floor buried structure 134 assembled with the first cover structure 137. The lower ends of the connection frame 131 are each inserted into the space between the first airtight sealing 138 inserted into of the first connection grooves 132 of the floor buried structure 134 and the second airtight sealing 139 inserted into the second connection grooves 136 of the first cover structure 137, so that the first and second airtight sealing 138, 139 is secured to the both inner and outer surfaces of the connection frame 131.

When the opening/closing door 106 laterally slides to an open/closed position, the connection frame 131 inserted into the second airtight frame 120 installed at the bottom of the opening/closing door 106 laterally slides, along the space between the first and second airtight sealing 138, 139, thereby performing the opening/closing transmission of the opening/closing door 106. Since the first and second airtight sealing 138, 139 is secured on the both inner and outer surfaces of the connection frame 131, drafts or noise coming into from the outside are easily prevented and the opening/closing door 106 is prevented from leaving its track.

Figure 12:
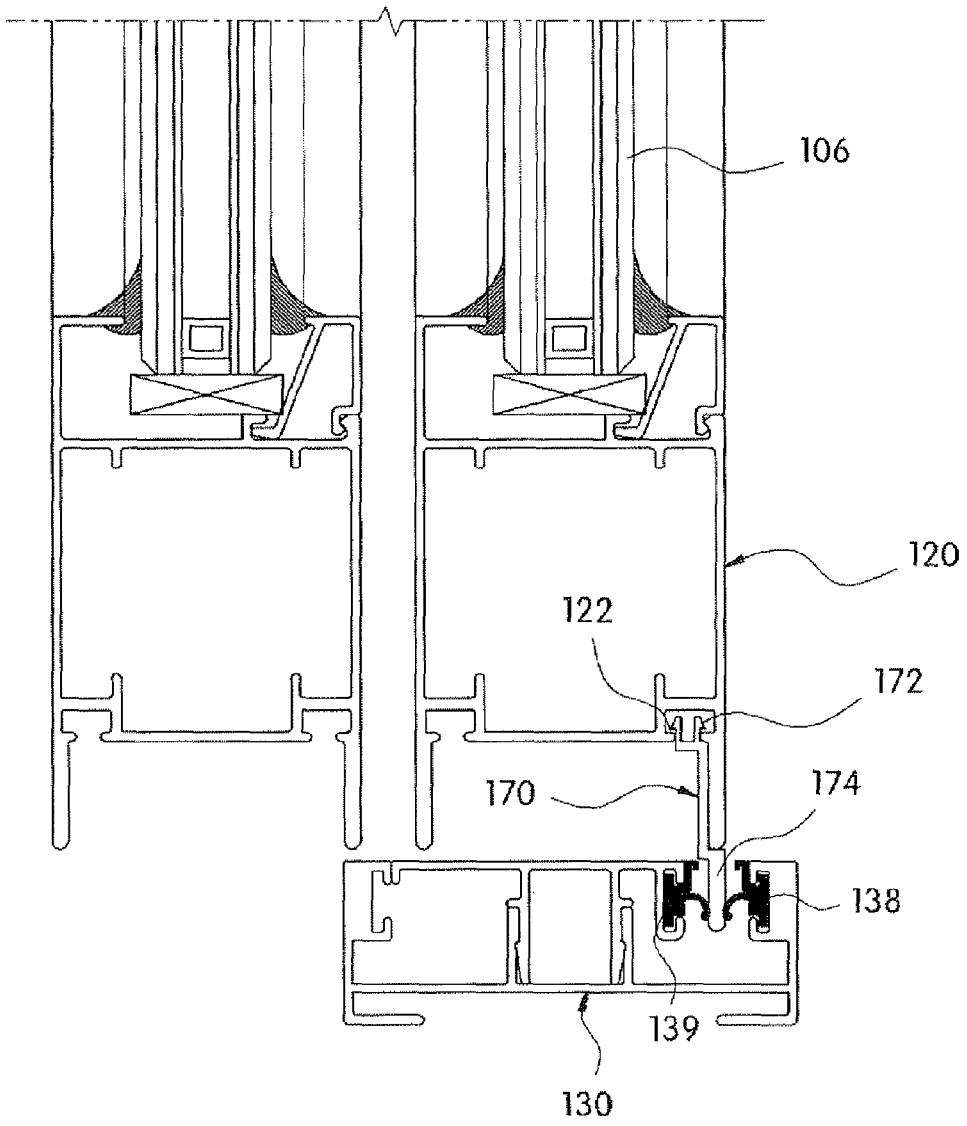
FIG. 12 is a cross-sectional view of one modified example of a connection structure between a second airtight frame and a floor buried structure of a first airtight maintaining structure in the constitution of the apparatus according to the present invention.

FIG. 12 shows a modified example of the connection structure between the second airtight frame and the floor buried structure of the first airtight maintaining structure in the constitution of the apparatus according to the present invention. As shown in FIG. 12, a connection rod 170 in a vertical type may be used as the connection structure. The connection rod 170 includes clip ends 172 and a sliding end 174. The clip ends 172 are formed at an upper position of the connection rod 170. The clip ends 172 are inserted and locked in the coupling groove 122 of the second airtight frame 120. The sliding end 174 is formed at a lower position of the connection rod 170. The sliding end 174 is inserted into the space between the first and second airtight sealing 138, 139, to slidably move upon the motion of opening/closing the opening/closing door 106.

The second airtight maintaining structure 140 is installed in a right-side door frame 108 facing the other side of the opening/closing door 106, so that when the opening/closing door 106 is closed, that side of the door is inserted.

The second airtight maintaining structure 140 comprises a wall buried structure 143, a second cover structure 146 and third and fourth airtight sealing 147, 148. The wall buried structure 143 includes third connection grooves 141 and third connection protrusions 142. The third connection grooves 141 are formed at both sides of the wall buried structure 143 and the third connection protrusions 142 protrude extending from the wall buried structure 143. The wall buried structure 143 is formed in the inner wall surface of the right-side door frame 108 in a single unit. The second cover structure 146 includes fourth connection protrusions 144 and fourth connection grooves 145. The fourth connection protrusions 144 protrude extending from the second cover structure 146 in a single unit, to be fitted into and connected to the third connection protrusions 142 of the wall buried structure 143. The fourth connection grooves 145 are formed at both outer sides of the second cover structure 146. Specifically, the third airtight sealing 147 is inserted into the third connection grooves 141 of the wall buried structure 143 and the fourth airtight sealing 148 is inserted into the fourth connection grooves 145 of the second cover structure 146, to be secured to both sides of the protruding ends 123 of the second airtight frame 120 installed at the other side which is the closed side of the opening/closing door 106.

In the state that the second cover structure 146 is locked into the wall buried structure 143 of the second airtight maintaining structure 140, when the opening/closing door 106 is closed, the protruding ends 123 of the second airtight frame 120 installed at the other side which is the closed side of the door 106 are inserted between the third and fourth airtight sealing 147, 148.

Accordingly, when the opening/closing door 106 is closed, since the third and fourth airtight sealing 147, 148 is secured to the both sides of the protruding ends 123 of the second airtight frame 120, the drafts and noise are easily prevented from coming through the gap between the opening/closing door 106 and the right-side door frame 108.

The third airtight maintaining structure 150 blocks the drafts and noise coming through the gap between the fixed door 102 and the opening/closing door 106. The third airtight maintaining structure 150 is finally assembled to the second airtight frame 120 assembled to the other side of the fixed door 102 and the second airtight frame 120 assembled to one side of the opening/closing door 106.

In more detail, the third airtight maintaining structure 150 comprises a first cover-type structure 153 and a second cover-type structure 156. The first cover-type structure 153 includes first locking ends 151 and fifth airtight sealing 152. The first locking ends 151 formed inside the first cover-type structure 153 in a single unit are inserted to be locked in the coupling grooves 122 of the protruding ends 123 of the second airtight frame 120 installed at the one side of the opening/closing door 106. The fifth airtight sealing 152 mounted at the side towards the fixed door 102 in the first cover-type structure 153 is secured to the second airtight frame 120 installed at the fixed door 102. The second cover-type structure 156 includes second locking ends 154 and sixth airtight sealing 155. The second locking ends 154 formed inside the second cover-type structure 156 in a single unit are inserted to be locked in the coupling grooves 122 of the protruding ends 123 of the second airtight frame 120 installed at the other side of the fixed door 102. The sixth airtight sealing 155 mounted at the side towards the opening/closing door 106 in the second cover-type structure 156 is secured to the second airtight frame 120 installed at the opening/closing door 106.

Accordingly, the drafts or noise coming into through the gap between the fixed door 102 and the opening/closing door 106 are easily prevented by the fifth airtight sealing 152 secured to the second airtight frame 120 installed at the fixed door 102 and the sixth airtight sealing 155 secured to the second airtight frame 120 installed at the opening/closing door 106.

Figure 7:
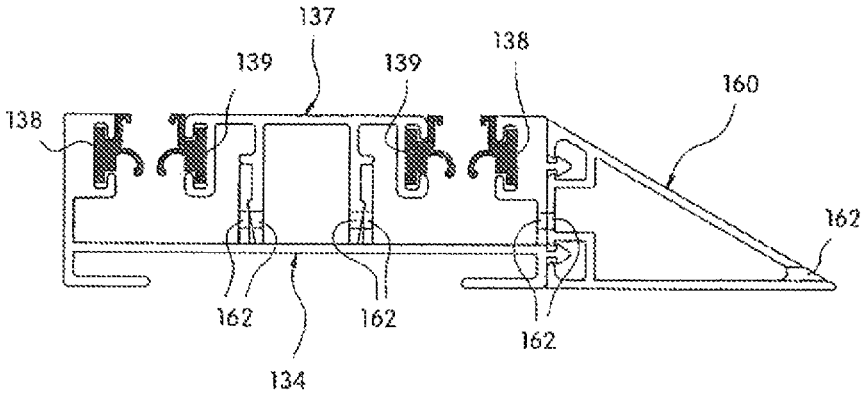
FIG. 7 is a main cross-sectional view of an inclination plate further mounted to the apparatus according to the present invention.
Figure 7:
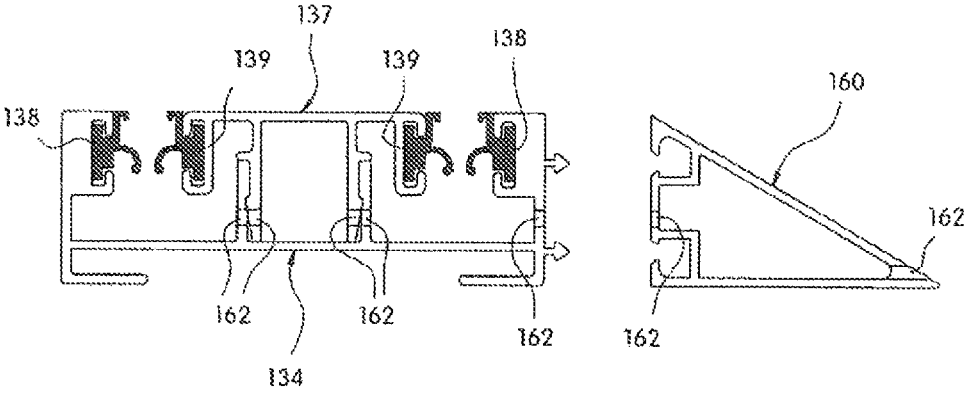

FIG. 7 shows the floor buried structure 134 according to a preferred embodiment of the present invention. As shown in FIG. 7, the floor buried structure 134 is not completely buried in the floor surface and it is installed on the floor surface. An inclination plate 160 in a hollow type which tilts from the inside to the outside is formed to be assembled to the outer surface of the floor buried structure 134 in a single unit. When a person enters/exits, (s)he is easily prevented from falling by the guide of the inclination plate 160 as her/his foot is trapped in the floor buried structure 134 installed on the floor surface.

Further, drainage holes 162 may be formed in the first connection protrusions 133 and outer surface of the floor buried structure 134 and the inclination plate 160, to remove the rainwater, etc. coming into the floor buried structure 134 to the outside.

Figure 8:
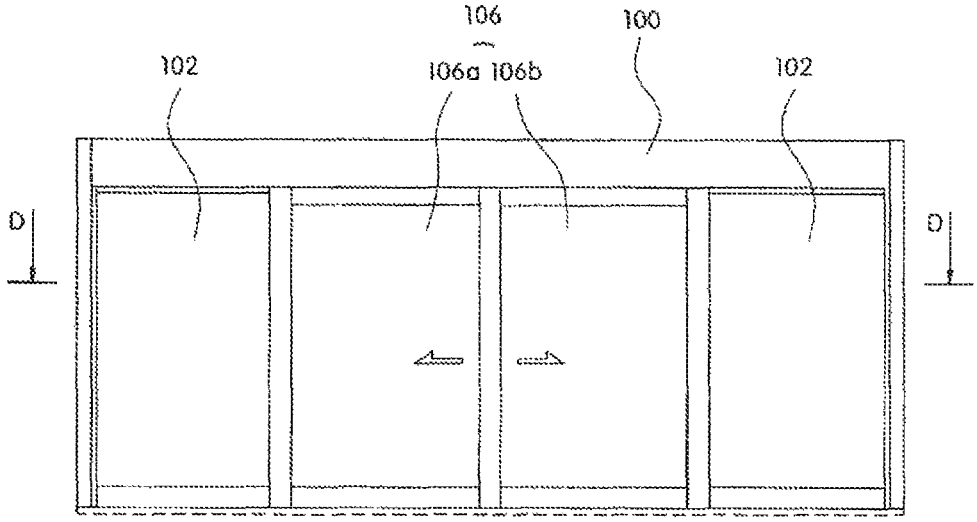
FIG. 8 is a schematic view of an automatic bi-parting door to which the apparatus according to the present invention is applied.
Figure 9:
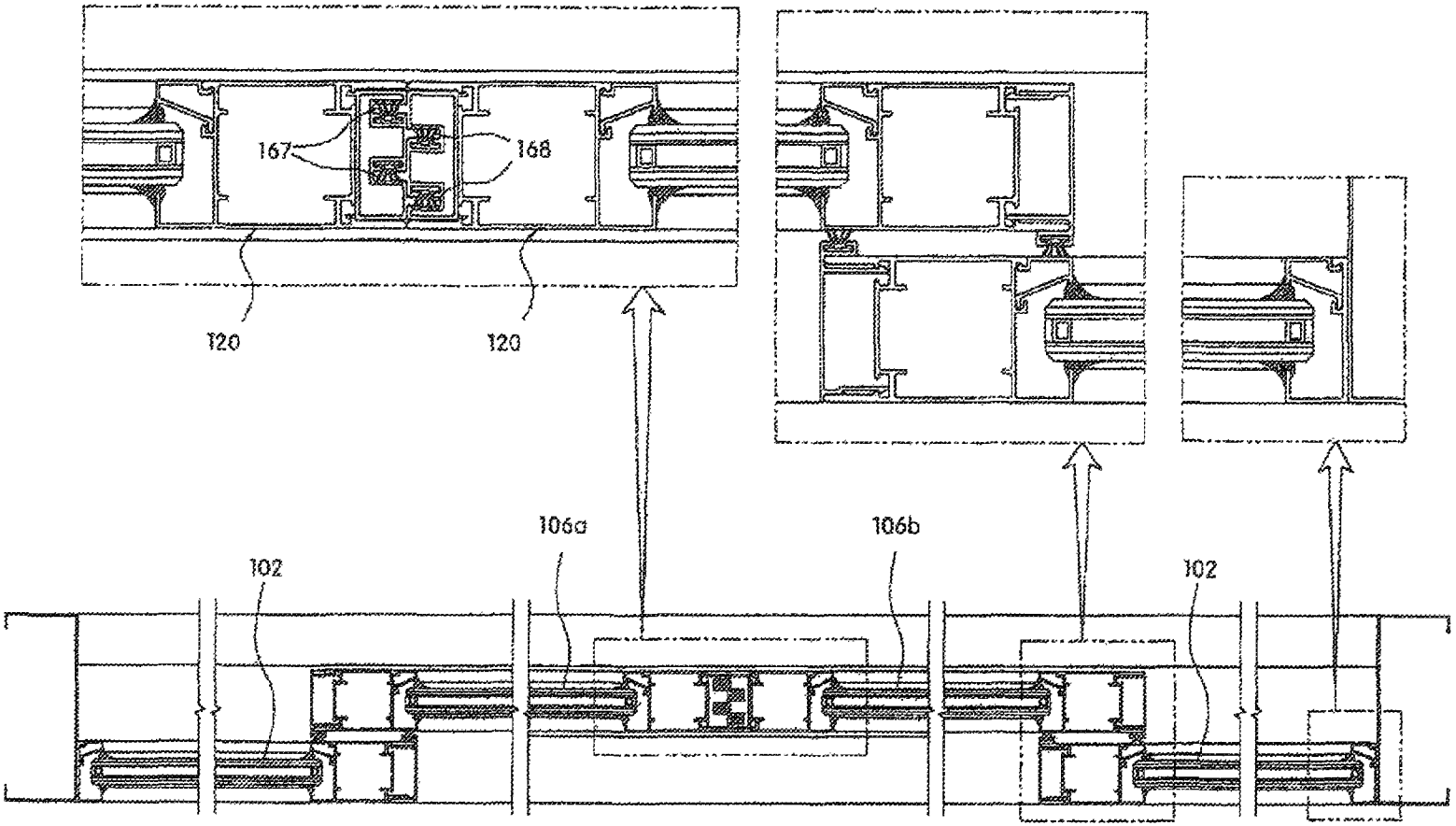
FIG. 9 is a sectional view taken along a Line D-D in FIG. 8.

FIGS. 8 and 9 show an automatic bi-parting door to which the apparatus according to another embodiment of the present invention is applied. That is, the opening/closing door 106 is in a two door structure. In this case, a first opening/closing door 106*a* and a second opening/closing door 106*b* slide in opposite directions to the open/closed position. Seventh airtight sealing 167 is mounted to the side of the first opening/closing door 106*a* which comes in contact with the second opening/closing 106*b* and simultaneously eighth airtight sealing 168 is mounted to the side of the second opening/closing door 106*b* which comes in contact with the first opening/closing 106*a* in the manner that the seventh and eighth airtight sealing 167, 168 is arranged to alternate each other. When the first opening/closing door 106*a* and the second opening/closing door 106*b* come in contact with each other to be dosed, the seventh and eighth airtight sealing 167, 168 prevents drafts or noise from coming into through the gap between the first opening/closing door 106*a* and the second opening/closing door 106*b*.

Figure 10:
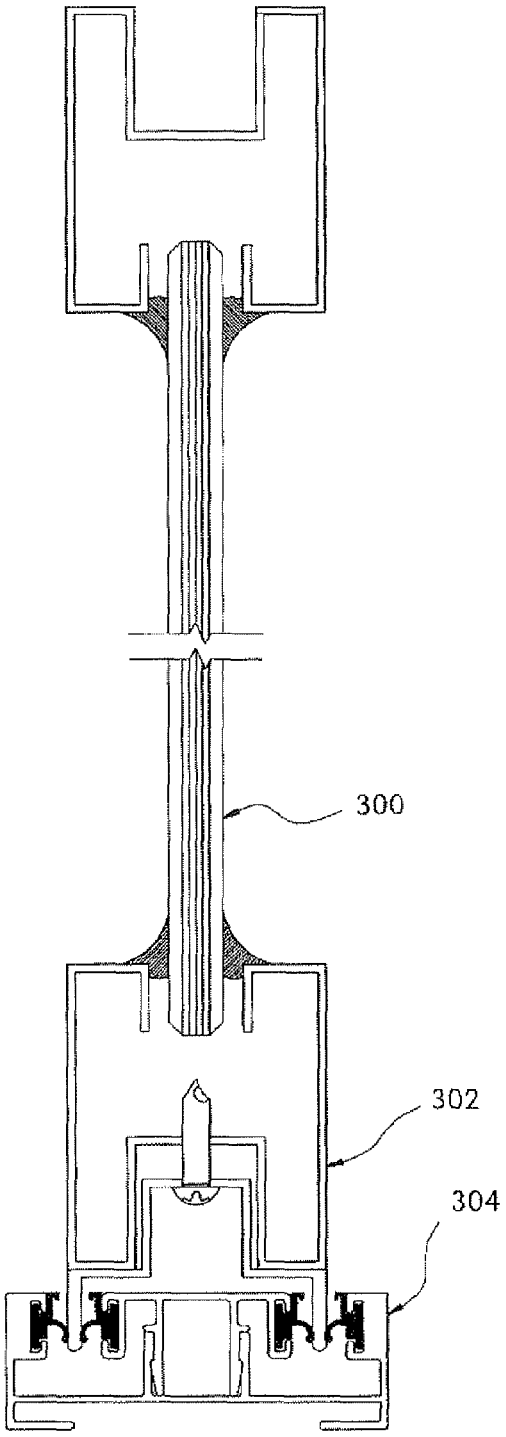
FIGS. 10 and 11 are cross-sectional views of an example where the apparatus according to the present invention is mounted to an edge made of tampered glass.
Figure 11:
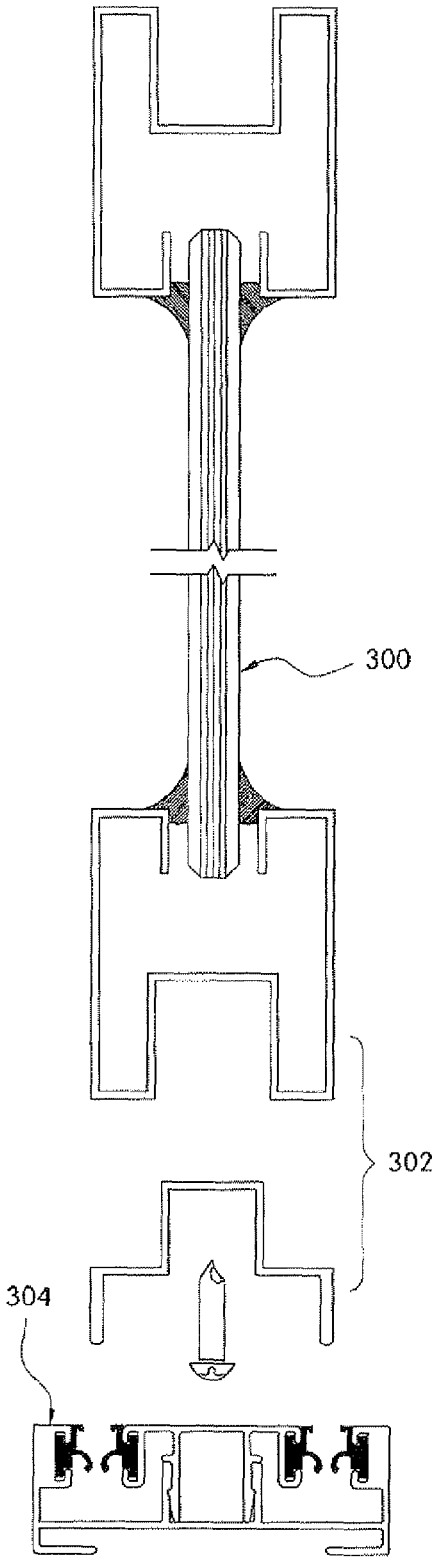
Figure 13:
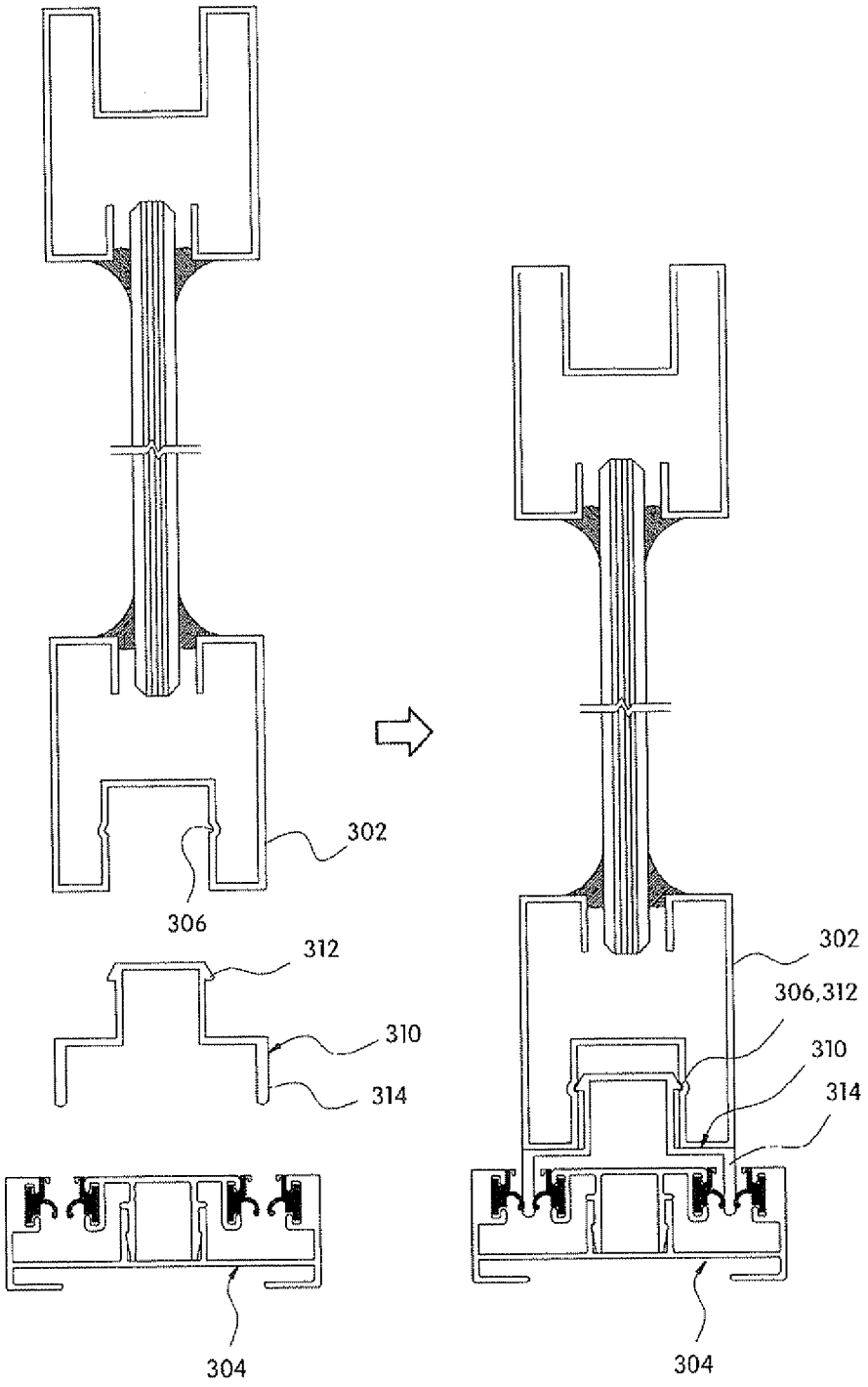
FIG. 13 is a cross-sectional view of the other modified example of a connection structure between an airtight frame and a floor buried structure of a tampered glass door when the apparatus according to the present invention is mounted to the edge made of tampered glass.

FIGS. 10 and 11 show a tampered glass 300 to which the apparatus according to another embodiment of the present invention is applied. An airtight frame 302 in the aforementioned structure is installed to the tampered door 300. A floor buried structure 304 to receive the airtight frame 302 is installed on the floor surface. As shown in FIG. 13, a connection structure 310 is used to connect the airtight frame 302 and the floor buried structure 304, thereby obtaining the effect of preventing drafts and noise.

The connection structure 310 includes protrusions 312 and sliding ends 314. The protrusions 312 are formed at an upper position of the connection structure 310, to be fitted into grooves 306 formed at a lower position of the airtight frame 302. The sliding ends 314 are formed at a lower position of the connection structure 310, to be slidably fitted into the sealing of the floor buried structure 304. Since the connection structure 310 connects the airtight frame and the floor buried structure of the tampered door, drafts and noise are prevented from passing beyond the door.

The invention claimed is:

1. An apparatus for an automatic door comprising:

a first airtight frame (110) to be assembled with a top of a fixed door (102) of the automatic door and a first side of the fixed door (102) coming in contact with a left-side door frame (104);

a second airtight frame (120) to be assembled with a bottom and a second side of the fixed door (102) and a top, bottom and a first and second sides of an opening and closing door (106) of the automatic door to be connected to an opening and closing driving means (200) for driving the opening and closing door to open and close, the first side of the opening and closing door (106) facing the left-side door frame (104) and the second side of the opening and closing door (106) facing a right-side door frame (108), said second airtight frame comprising:

a hollow frame (124) shaped as a hollow rectangular sectional structure including a groove (121),protruding ends (123) having coupling grooves (122), and a flange (125), wherein the groove (121) is formed at a first position on one side of the hollow frame (124), the protruding ends (123) with the coupling grooves (122) are formed at a second side of the hollow frame (124), and the flange (125) extends from a second position of the one side of the hollow frame (124), to be inserted into a molded material (103) at the fixed door (102) or the opening and closing door (106), and a coupling clip (128) including coupling legs (126) and a coupling protrusion (127), wherein the coupling legs (126) are formed at one side of the coupling clip (128), to be fitted into the groove (121), and the coupling protrusion (127) is formed at another side thereof, to be inserted into the molded material (103) of the fixed door (102) or the opening and closing door (106);

a first airtight maintaining structure (130) adapted to be buried in a floor surface facing a bottom of the second airtight frame (120) so that the bottom of the second airtight frame (120), installed at the bottom of the opening and closing door (106), is adapted to be inserted into the first airtight maintaining structure (130) to slide along in both opening and closing directions, said first airtight maintaining structure comprising:

a connection frame (131) adapted to be inserted into protruding ends (123) of the second airtight frame (120) installed at the bottom of the opening and closing door (106), a floor buried structure (134) including first connection grooves (132) and first connection protrusions (133), wherein the first connection grooves (132) are formed at a first and a second inner sides of the floor buried structure (134) and the first connection protrusions (133) upwardly protrude from a center of a bottom of the floor buried structure, so that the floor buried structure (134) is buried in the floor surface facing the bottom of the second airtight frame (120), a first cover structure (137) including second connection protrusions (135) and second connection grooves (136), wherein the second connection protrusions (135) downwardly protrude from a bottom of the first cover structure (137), and are adapted to be connected by being inserted into the first connection protrusions (133) of the floor buried structure (134), and wherein the second connection grooves (136) are formed at a first and a second outer sides of the first cover structure (137), and a first and a second airtight sealing (138, 139) adapted to be inserted into the first connection grooves (132) of the floor buried structure (134) and the second connection grooves (136) of the first cover structure (137), respectively, so as to be secured to a first side and a second side of the connection frame (131);

a second airtight maintaining structure (140) adapted, to be installed at the right-side door frame (108) facing the second side of the opening and closing door (106) such that in a closed state, the second side of the opening and closing door (106) is inserted into the second airtight maintaining structure (140); and a third airtight maintaining structure (150) adapted to be assembled with the second airtight frame (120) the second side of the fixed door (102) and the second airtight frame (120) is adapted to be assembled with the first side of the opening and closing door (106).

2. The apparatus according to claim 1, wherein the first airtight frame (110) comprises:

an outer plate (113) including an outer plate flange (111) and an outer plate groove (112), wherein the outer plate flange (111) downwardly extends from one side of the outer plate (113), to be inserted into the molded material (103) at one side of the fixed door (102), and the outer plate groove (112) is formed on an inner face of the outer plate (113); and a coupling clip (116) including coupling legs (114) and a coupling protrusion (115), wherein the coupling legs (114) are formed at one side of the coupling clip (116), to be fitted into the outer plate groove (112) of the outer plate (113) and the coupling protrusion (115) is formed at another side of the coupling clip (116), to be inserted into the molded material (103) at another side of the fixing door (102).

3. The apparatus according to claim 1, wherein the second airtight maintaining structure (140) comprises:

a wall buried structure (143) including third connection grooves (141) and third connection protrusions (142), wherein the third connection grooves (141) are formed at each end of the wall buried structure, and the third connection protrusions (142) protrude from the wall buried structure (143) and the wall buried structure (143) is formed at an inner wall side of the right-side door frame (108);

a second cover structure (146) including fourth connection protrusions (144) and fourth grooves (145), wherein the fourth connection protrusions (144) protrude from the second cover structure (146), and are adapted to be inserted into the third connection protrusions (142) of the wall buried structure (143), and the fourth connection grooves (145) are formed at outer sides of the second cover structure (146); and third and fourth airtight sealing (147, 148) to be inserted into the third connection grooves (141) of the wall buried structure (143) and the fourth connection grooves (145) of the second cover structure (146), respectively, so as to be secured to both sides of the protruding ends (123) of the second airtight frame (120) installed at the second side of the opening and closing door (106).

4. The apparatus according to claim 1, wherein the third airtight maintaining structure (150) comprises:

a first cover structure (153) of the third airtight maintaining structure, including first locking ends (151) and fifth airtight sealing (152), wherein the first locking ends (151) are formed at an inner side of the first cover structure (153) of the third airtight maintaining structure, to be insertedly locked in the coupling grooves (122) of the protruding ends (123) of the second airtight frame (120) installed at the first side of the opening and closing door (106), the fifth airtight sealing (152) is mounted at the first side of the opening and closing door (106) towards the fixed door (102), to be secured to the second airtight frame (120) installed at the fixed door (102); and a second cover structure (156) of the third airtight maintaining structure including second locking ends (154) and sixth airtight sealing (155), to be locked in the coupling grooves (122) of the protruding ends (123) of the second airtight frame (120) installed at the second side of the fixed door (102), and the sixth airtight sealing (155) is mounted at the second side of the fixed door (102) towards the opening and closing door (106), to be secured to the second airtight frame (120) installed at the opening and closing door (106).

5. The apparatus according to claim 1 further comprising: when the floor buried structure (134) is not completely buried in the floor surface, an inclination plate (160) of an inclined hollow member is adapted to be assembled at an outer wall surface of the floor buried structure (134),the inclination plate originating at the floor surface and terminating proximal to a top edge of the outer wall surface; and drainage holes (162) formed on the first connection protrusions (133) and the outer wall surface of the floor buried structure (134) and the inclination plate (160).

6. The apparatus according to claim 1 further comprising: when the opening and closing door (106) is in a bi-parting door structure, seventh airtight sealing (167) to be installed at a side of a first opening and closing door (**106*a*) coming in contact with a second opening and closing door (106*b*); and eighth airtight sealing (168) to be installed at a side of the second opening and closing door (106*b*) coming in contact with the first opening and closing door (106*a*), wherein each of the seventh airtight sealing (167) and each of the eighth airtight sealing (168**) are arranged in an alternating pattern.

* * * * *